US008591012B2

(12) United States Patent
Yoshino et al.

(10) Patent No.: US 8,591,012 B2
(45) Date of Patent: Nov. 26, 2013

(54) LIQUID EJECTION APPARATUS

(75) Inventors: Hiroshi Yoshino, Kawasaki (JP); Takashi Nojima, Tokyo (JP); Yuji Nakano, Kawasaki (JP); Yoshitaka Okamura, Yamato (JP); Masakazu Tsukuda, Yokohama (JP); Kanto Kurasawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 305 days.

(21) Appl. No.: 12/912,679

(22) Filed: Oct. 26, 2010

(65) Prior Publication Data

US 2011/0128329 A1 Jun. 2, 2011

(30) Foreign Application Priority Data

Dec. 1, 2009 (JP) ..... 2009-273894

(51) Int. Cl.

| | |
|---|---|
| ***B41J 2/175*** | (2006.01) |
| ***B41J 29/38*** | (2006.01) |
| ***B41J 29/393*** | (2006.01) |
| ***B41J 2/17*** | (2006.01) |

(52) U.S. Cl.

USPC ..... 347/85; 347/6; 347/19; 347/84

(58) Field of Classification Search

USPC ..... 347/6, 7, 19, 84, 85

See application file for complete search history.

(56) References Cited

U.S. PATENT DOCUMENTS

2009/0174735 A1* 7/2009 Yamada ..... 347/7

FOREIGN PATENT DOCUMENTS

| | | | | |
|---|---|---|---|---|
| JP | 2000-229419 | A | | 8/2000 |
| JP | 2003-170610 | A | | 6/2003 |
| JP | 2005-066520 | A | | 3/2005 |
| JP | 2006-192794 | A | | 7/2006 |
| JP | 2006-224028 | A | | 8/2006 |
| JP | 2006224028 | A | * | 8/2006 |
| JP | 2006-231131 | A | | 9/2006 |
| JP | 2009-248381 | A | | 10/2009 |

* cited by examiner

*Primary Examiner* — Jannelle M Lebron

(74) *Attorney, Agent, or Firm* — Canon USA, Inc., IP Division

(57) ABSTRACT

A liquid ejection apparatus includes a pressure sensor and a determining unit. The pressure sensor is configured to detect a pressure in an ink supply path for use in supplying ink from an ink tank to a recording head. The determining unit determines whether the ink supply path is anomalous based on a result of detection of the pressure in the ink supply path by the pressure sensor performed in response to application of a fluctuating pressure to the ink in the ink tank.

7 Claims, 8 Drawing Sheets

LIQUID EJECTION APPARATUS

BACKGROUND OF THE INVENTION

1. Field of the Invention

The present invention relates to a liquid ejection apparatus that ejects liquid from a recording head and, in particular, to a liquid ejection apparatus that supplies liquid from a liquid container holding the liquid to a recording head through a supply tube.

2. Description of the Related Art

There is an ink jet recording apparatus that ejects liquid from a recording head to record information on a recording medium.

Japanese Patent Laid-Open No. 2005-66520 describes a recording apparatus that supplies pigment ink from an ink pack fixed to the main body of the printer to a recording head through an ink supply tube and ejects the pigment ink from the recording head to record information on a recording sheet. This patent document also describes the prevention of settlement of pigment particles within the ink pack by up-and-down movements of a stirring element provided in the ink pack.

This patent document also describes arranging a semiconductor strain-gage pressure transducer as an ink end sensor in an ink flow path from the ink pack to the recording head. The ink flow path is sealed to the atmosphere, and when the ink pack becomes empty of ink, a negative pressure in the ink flow path increases. Sensing the absence of ink in the ink pack by detecting the increase in negative pressure is described in the above-mentioned patent document.

However, with the configuration described in the above-mentioned patent document, if the ink supply tube is cut or anomaly occurs, such as the occurrence of a crack, the ink end sensor does not detect a negative pressure. Thus when anomaly occurs in the ink supply tube, a negative pressure is not formed in the ink supply tube, and the ink end sensor does not function. Additionally, because there is no configuration for detecting anomaly in the ink supply tube, when anomaly occurs in the ink supply tube, a problem arises in that ink leaks in the printer.

The apparatus described in the above-mentioned patent document does not have a configuration for detecting whether a stirring element normally operates. Therefore, when anomaly occurs in the operation of the stirring element, the density of ink supplied from the ink pack is not uniform. This may cause a problem in that the recording head poorly ejects ink or the image quality degrades.

SUMMARY OF THE INVENTION

The present invention provides a liquid ejection apparatus capable of detecting anomaly in an ink supply path for use in supplying ink from an ink tank to a recording head.

According to an aspect of the present invention, a liquid ejection apparatus includes a recording head, an ink tank, an ink supply path, a pressure applying unit, a pressure sensor, and a determining unit. The recording head is configured to eject ink. The ink tank is configured to hold ink to be supplied to the recording head. The ink supply path is used in supplying ink from the ink tank to the recording head. The pressure applying unit is configured to apply a pressure to the ink in the ink tank. The pressure sensor is configured to detect a pressure in the ink supply path. The determining unit is configured to determine whether the ink supply path is anomalous based on a result of detection of the pressure in the ink supply path by the pressure sensor performed in response to application of the pressure to the ink in the ink tank by the pressure applying unit.

Further features of the present invention will become apparent from the following description of exemplary embodiments with reference to the attached drawings.

DESCRIPTION OF THE EMBODIMENTS

First Embodiment

Best mode for carrying out the present invention is described below with reference to the drawings.

Figure 1:
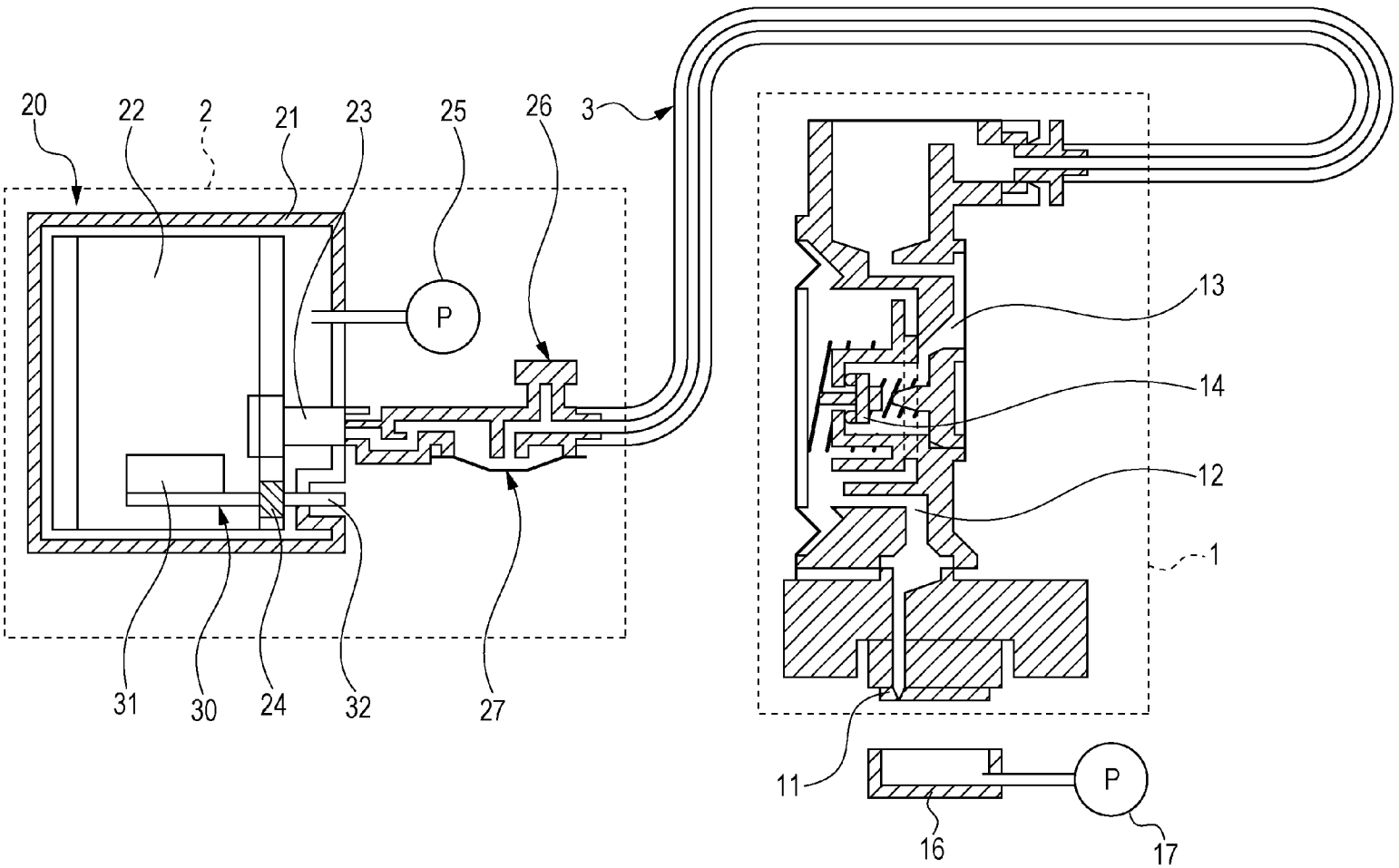
FIG. 1 is a schematic diagram of a liquid ejection apparatus to which an embodiment of the present invention is applicable.

FIG. 1 is a schematic diagram of a liquid ejection apparatus to which an embodiment of the present invention is applicable. A recording head section 1 ejects liquid toward a recording medium to record information. An ink tank accommodating section 2 accommodates an ink tank. An ink supply tube 3 is used in supplying ink from the ink tank accommodating section 2 to the recording head section 1.

First, a configuration of the recording head section 1 is described. A nozzle portion 11 ejects ink being liquid toward a recording medium. A first liquid chamber 12 holds ink. A second liquid chamber 13 holds ink. A supply control valve 14 is arranged at a border between the first liquid chamber 12 and the second liquid chamber 13.

When ink is ejected through the nozzle portion 11 in the recording head section 1 and the ink in the first liquid chamber 12 is consumed, the first liquid chamber 12 enters a negative pressure state. When the first liquid chamber 12 enters a negative pressure state, displacement of the supply control valve 14 changes the first liquid chamber 12 and the second liquid chamber 13 from a state in which they do not communicate with each other to a state in which they communicate with each other. The state in which they communicate with each other causes ink in the second liquid chamber 13 to flow into the first liquid chamber 12. The increase in ink in the first liquid chamber 12 eliminates the negative pressure state of the first liquid chamber 12, the supply control valve 14 is displaced to an original state, and the first liquid chamber 12 and the second liquid chamber 13 return to a state in which they do not communicate with each other.

The recording head section 1 is mounted on a carriage (not illustrated). The carriage reciprocates in the direction of the width of a recording medium. With the movement of the carriage, ink is ejected through the nozzle portion 11 toward the recording medium, thus forming an image on the recording medium.

The liquid ejection apparatus is provided with a cap 16 arranged at a location that faces the nozzle portion 11 when the carriage is moved to a non-recording region. The cap 16 can come into contact with the nozzle portion 11 and is arranged so as to be movable to a first position where the cap 16 is in contact with the nozzle portion 11 and the nozzle portion 11 is sealed and to a second position where the cap 16 is separated from the nozzle portion 11. The cap 16 is connected to a suction pump 17. Driving the suction pump 17 when the cap 16 is in contact with the nozzle portion 11 can make the inside of the cap 16 be in a negative pressure state and discharge ink through the nozzle portion 11. The cap 16 and the suction pump 17 serve as a suction unit configured to suck ink from a recording head.

Next, a configuration of the ink tank accommodating section 2 is described. An ink tank 20 is removably attached to the ink tank accommodating section 2. The ink tank 20 includes a housing 21, an ink bag 22, an ink supply port 23, and a stirring member 30. The ink supply port 23 communicates with the inside of the ink bag 22 and is fixed to the housing 21. The ink supply port 23 functions to supply ink held in the ink bag 22 to the outside of the ink bag 22.

The stirring member 30 for stirring ink in the ink bag 22 is disposed in the ink bag 22. If ink in the ink bag 22 is pigment ink, pigment particles settles down. To address this, the stirring member 30 for stirring the inside of the ink bag 22 is disposed. The stirring member 30 includes a stirring portion 31 arranged inside the ink bag 22 and a driven portion 32 projecting from the ink bag 22 and the housing 21. The stirring member 30 is attached to the ink bag 22 by a stirring member support 24 provided to the ink bag 22. The stirring member support 24 supports the stirring member 30 so as to allow it to relatively move with respect to the ink bag 22 and retains a watertight state of the ink bag 22. With this configuration, when the driven portion 32 is caused to reciprocate, the stirring member 30 is caused to pivot about the stirring member support 24. In response to this, the stirring portion 31 in the ink bag 22 is also caused to reciprocate, thereby stirring ink in the ink bag 22. Reciprocation of the stirring portion 31 applies a fluctuating pressure to the ink in the ink tank. That is, the stirring portion 31 serves as a pressure applying unit configured to apply a pressure to ink in an ink tank.

For the present embodiment, a solenoid is used in causing the driven portion 32 to reciprocate. However, a pump for generating a stream in the ink bag or a structure for generating vibrations in the ink bag may also be used.

A pressure pump 25 applies a pressure to a space between the housing 21 and the ink bag 22. Driving the pressure pump 25 presses the ink bag 22, thus enabling the ink in the ink bag 22 to be supplied to the outside of the ink bag 22 through the ink supply port 23. As described below, for the present embodiment, the ink in the ink bag 22 is supplied from the ink supply port 23 to the recording head section 1.

The ink tank accommodating section 2 is provided with an attachment detection sensor (not illustrated) for detecting attachment of the ink tank 20 to the ink tank accommodating section 2. For the present embodiment, the attachment detection sensor includes a member that is displaced in response to attachment of the ink tank 20 and a sensor for detecting the displacement of the member. The attachment detection sensor is not limited to the above-described configuration. For instance, in response to displacement of the member in the attachment detection sensor upon attachment of the ink tank 20, the sensor may become electrically conducting.

The ink tank 20 may be provided with a memory in which information regarding ink, such as the type of ink held in the ink tank and the volume of the ink, is stored. If electrical connection with the main body of the apparatus by the memory upon attachment of the ink tank 20 to the ink tank accommodating section 2 can be detected, the attachment detection sensor can be omitted.

Next, a configuration of the ink supply tube 3 is described. The ink supply tube 3 has a first end connected to the ink tank accommodating section 2 and a second end connected to the second liquid chamber 13. The ink in the ink bag 22 is supplied from the ink supply port 23 to the second liquid chamber 13 through the ink supply tube 3. The ink supply tube 3 can be made of a material capable of preventing evaporation of the ink in the tube and also preventing entrance of air into the tube from the outside. For the present embodiment, because the recording head section 1 is moved together with the carriage, the ink supply tube 3 can be made of a flexible material.

Figure 2:
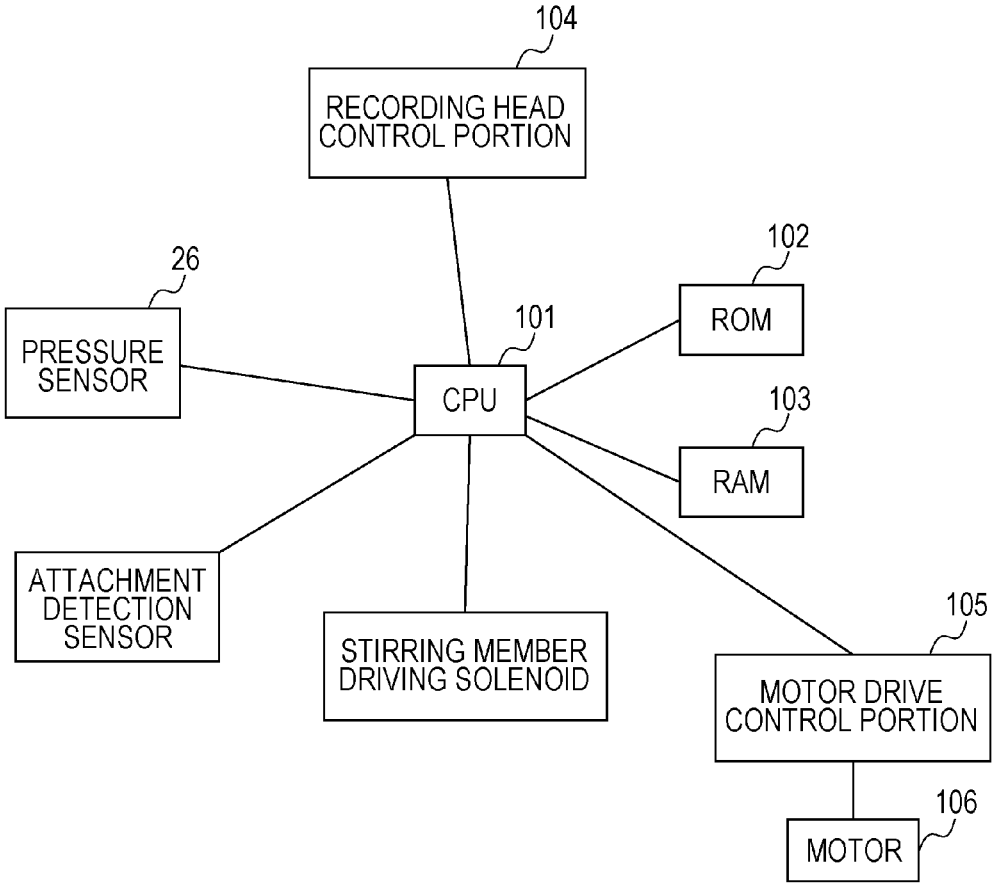
FIG. 2 is a block diagram of a liquid ejection apparatus to which an embodiment of the present invention is applicable.

FIG. 2 is a block diagram of a liquid ejection apparatus to which an embodiment of the present invention is applicable. A central processing unit (CPU) 101 exercises control over operations of the liquid ejection apparatus. A read-only memory (ROM) 102 is one in which a control program for causing the liquid ejection apparatus to operate and a constant used therein are stored. A random-access memory (RAM) 103 is one in which a temporary variable for causing the liquid ejection apparatus to operate is stored. The CPU 101 is connected to a pressure sensor 26, the attachment detection sensor, and a stirring member driving solenoid.

The CPU 101 is also connected to a recording head control portion 104, a motor drive control portion 105, and a motor 106.

Next, a configuration of the pressure sensor 26 and an operation of detecting an ink end by the pressure sensor 26 are described with reference to FIG. 1. The pressure sensor 26 is provided to the ink tank accommodating section 2 and directly measures a pressure in the ink supply tube 3.

When the recording head section 1 performs a recording operation, the ink in the first liquid chamber 12 is consumed, the supply control valve 14 is opened, and the ink in the second liquid chamber 13 is supplied to the first liquid chamber 12. Because the ink in the second liquid chamber 13 is also consumed, the ink in the ink tank 20 is continuously supplied to the second liquid chamber 13 through the ink supply tube 3. When the ink in the ink tank 20 is fully consumed, a negative pressure occurring in the recording head section 1 cannot be compensated for by ink supply, and the ink supply path including the ink supply tube 3 rapidly enters a negative pressure state. When the ink supply path is in a negative pressure state, detection of the negative pressure state by the pressure sensor 26 enables an ink end to be detected.

Figure 3:
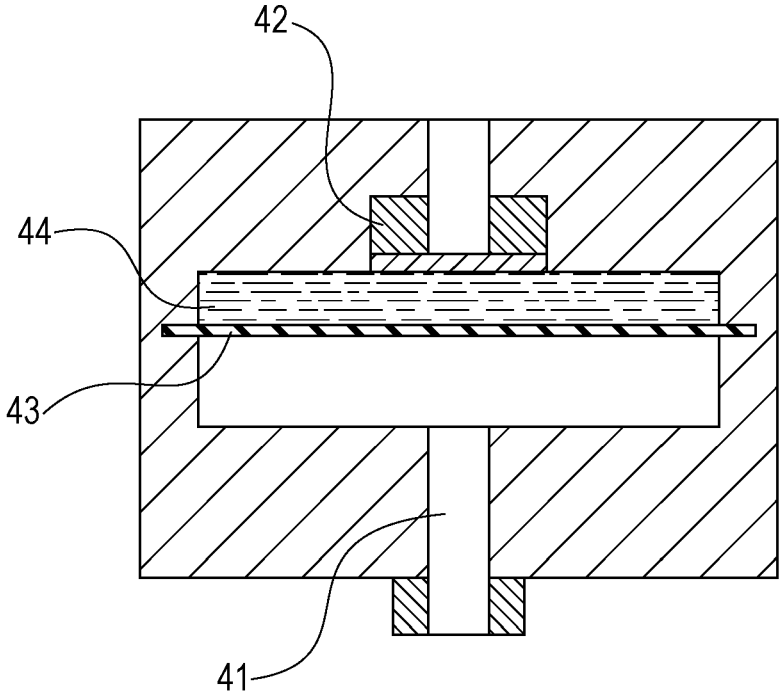
FIG. 3 is a cross-sectional view for use in describing a pressure sensor of the liquid ejection apparatus.
Figure 4:
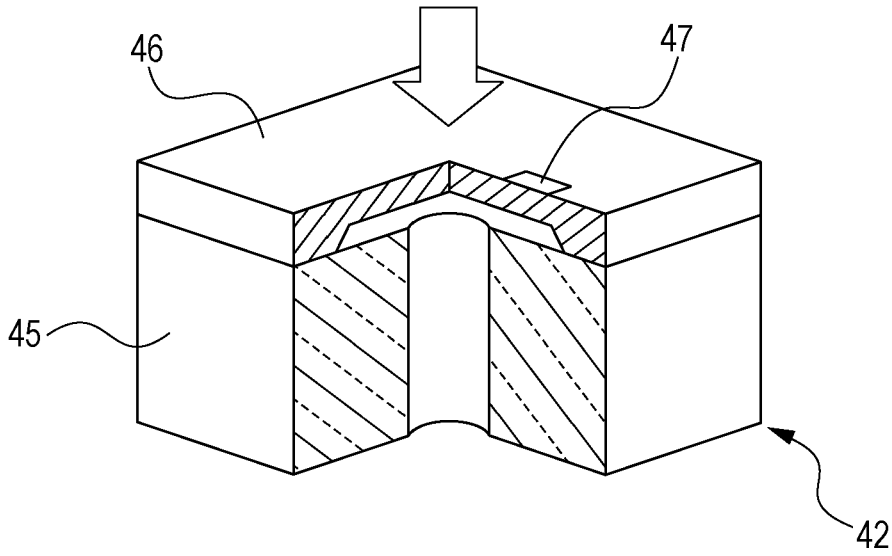
FIG. 4 is a perspective view for use in describing a sensor chip of the pressure sensor.

Next, a configuration of the pressure sensor 26 is described using FIGS. 3 and 4. FIG. 3 is a cross-sectional view for use in describing the pressure sensor of the liquid ejection apparatus. For the present embodiment, a semiconductor pressure sensor is used as the pressure sensor.

Referring to FIG. 3, a pressure detection port 41 communicates with the ink supply path, and a sensor chip 42 detects a pressure of fluid. A diaphragm 43 and silicon oil 44 are disposed between the pressure detection port 41 and the sensor chip 42. The pressure in the ink supply path is conveyed to the sensor chip 42 through the diaphragm 43 and the silicon oil 44 and is detected by the sensor chip 42. The diaphragm 43 can be made of a thin film using a highly corrosion-resistant material, such as SUS 316 stainless steel, for example. This can avoid ink in the ink supply path from directly coming into contact with the sensor chip 42 and prevent corrosion of the sensor chip 42.

FIG. 4 is a perspective view for use in describing the sensor chip of the pressure sensor. In the sensor chip 42, a silicon substrate 46 is bonded to a glass base 45. A silicon gauge resistor 47 is disposed on the silicon substrate 46. As indicated by the arrow illustrated in FIG. 4, a pressure is applied to the silicon substrate 46 through the pressure detection port 41. When the pressure is applied to a substantially central part of the silicon substrate 46, the shape of the silicon substrate 46 is altered and the silicon gauge resistor 47 is distorted. The distortion of the silicon gauge resistor 47 changes the value of resistance of the silicon gauge resistor 47, and the change is detected as fluctuations in the output voltage by an electric circuit (not illustrated) connected to the silicon gauge resistor 47. The output voltage obtained by such a manner is input to the CPU 101, which is illustrated in FIG. 2, and the input voltage is converted into a pressure. In this way, the pressure in the ink supply path is detectable.

For the present embodiment, a semiconductor pressure sensor is used as a structure for detecting a pressure. However, a structure that detects a pressure by the use of a displacement sensing device for sensing displacement of a flexible film or rubber may be used. Examples of the displacement sensing device can include a reflective photointerrupter, a device employing laser, and a device employing ultrasonic waves.

Figure 5A:
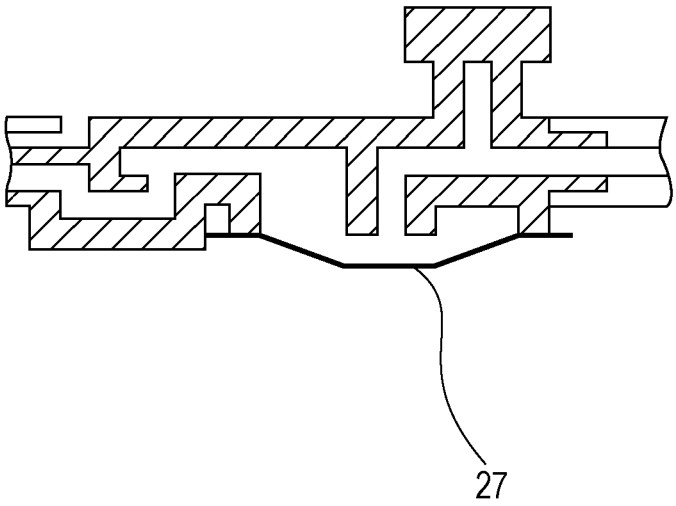
FIGS. 5A and 5B are cross-sectional views for use in describing a differential pressure valve of the liquid ejection apparatus.
Figure 5B:
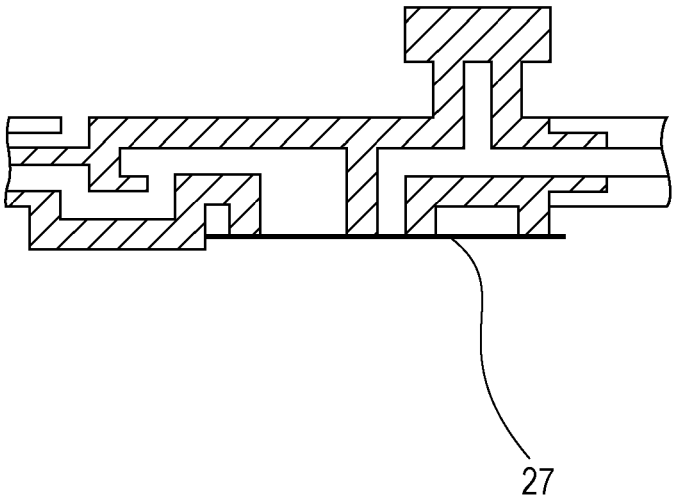

Next, a configuration of a differential pressure valve 27 is described using FIGS. 5A and 5B. FIGS. 5A and 5B are cross-sectional views for use in describing the differential pressure valve of the liquid ejection apparatus. As illustrated in FIG. 1, the differential pressure valve 27 is located in the ink supply path upstream of the pressure sensor 26. The differential pressure valve 27 is made of a flexible member, such as a film, and is a valve opened or closed depending on the difference between the pressure upstream of and the pressure downstream of the differential pressure valve 27. FIG. 5A illustrates the differential pressure valve 27 being opened, whereas FIG. 5B illustrates the differential pressure valve 27 being closed. For the present embodiment, the differential pressure valve 27 is closed when a negative pressure at or above a specific value is applied thereto from the ink supply tube 3, which is downstream of the differential pressure valve 27; the differential pressure valve 27 is opened when a positive pressure at or above a specific value is applied thereto from the ink tank 20, which is upstream of the differential pressure valve 27.

Figure 6:
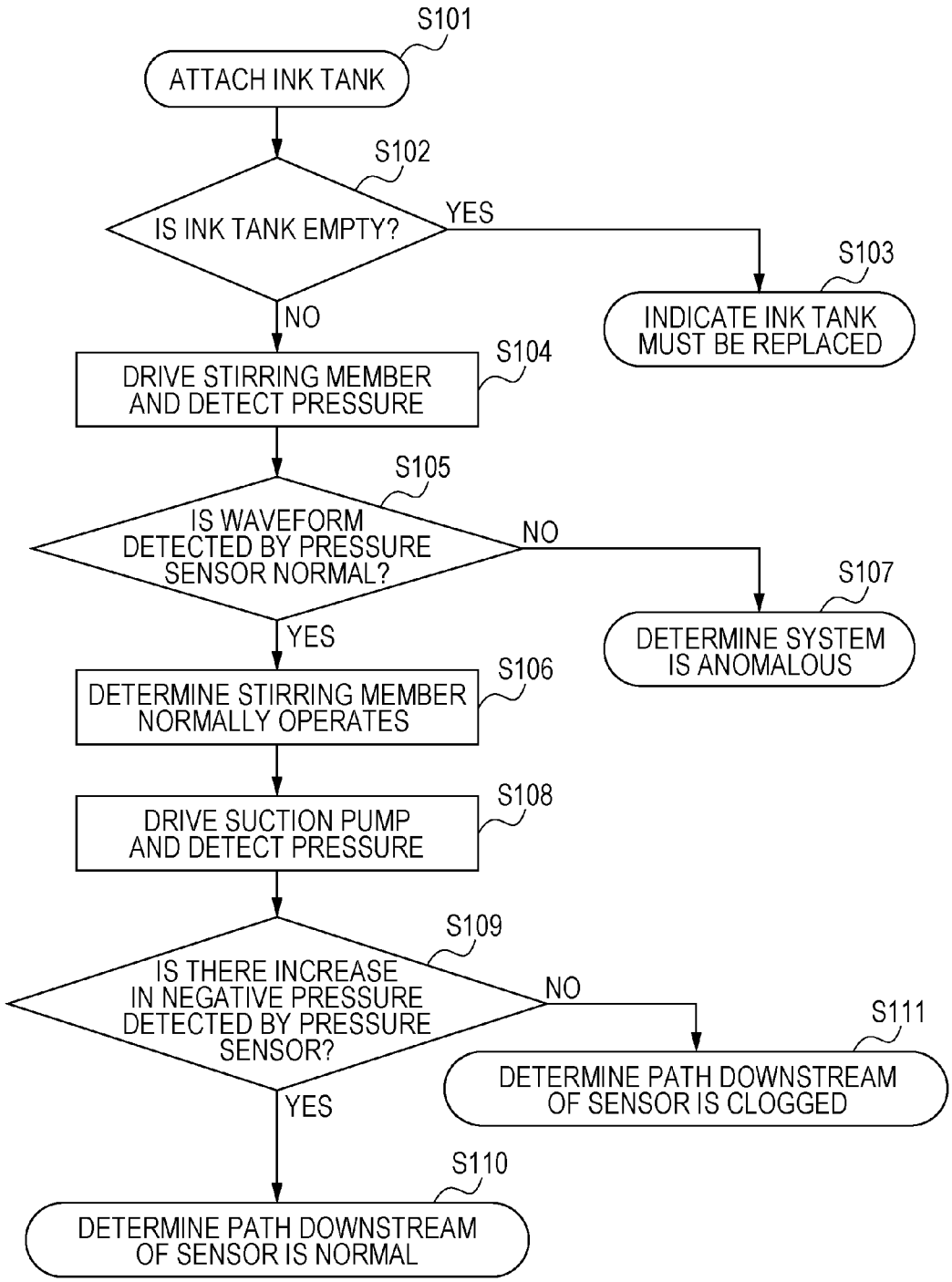
FIG. 6 is a flowchart of an operation sequence according to a first embodiment.

FIG. 6 is a flowchart of an operation sequence according to a first embodiment. In S101, when the ink tank 20 is attached to the ink tank accommodating section 2, the main body of the liquid ejection apparatus identifies the attachment of the ink tank 20 by the use of an ink tank presence/absence detection mechanism, and a detection sequence starts. Then in S102, the CPU 101 refers to the content of the memory provided to the ink tank 20 and determines the amount of ink remaining in the ink tank 20.

When the determination of the amount of ink remaining in the ink tank 20 in S102 is that the ink tank 20 is empty (YES in S102), an indication that prompts a user to replace the ink tank is provided in S103. When the determination is that the ink tank 20 is not empty (NO in S102), an operation of driving the stirring member 30 and detecting the pressure in the ink supply path by the pressure sensor 26 is carried out in S104.

The operation of driving the stirring member 30 and detecting the pressure in the ink supply path by the pressure sensor 26 in S104 is carried out in the following way. First, detection by the pressure sensor 26 is started, and results of the detection are sequentially stored in the RAM 103. After waiting for a specific period of time, the stirring member 30 is driven for a specific period of time. When a specific period of time has elapsed after the completion of the driving of the stirring member 30, the detection by the pressure sensor 26 is completed. In S105, the results of the detection stored in the RAM 103 are determined by the CPU 101.

Figure 7:
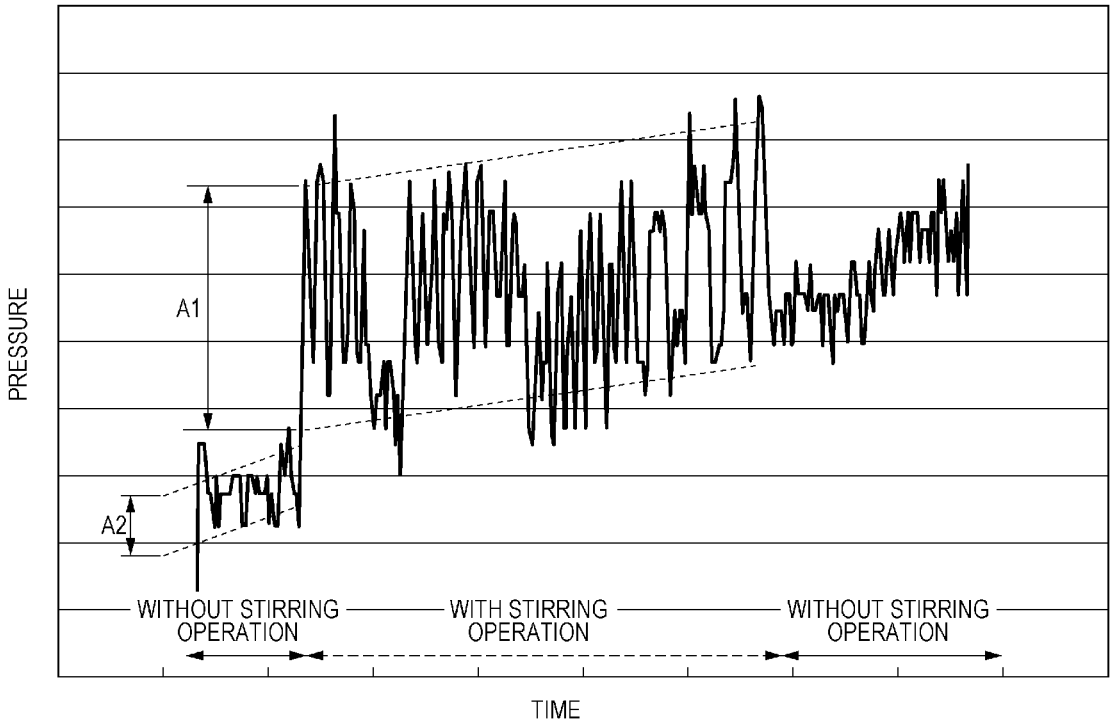
FIG. 7 is a graph that illustrates a pressure waveform obtained by the pressure sensor.

FIG. 7 is a graph that illustrates a pressure waveform obtained by the pressure sensor. The pressure waveform illustrated in FIG. 7 is one occurring when the stirring member 30 normally operates. In the graph illustrated in FIG. 7, the horizontal axis indicates time and the vertical axis indicates pressure. A1 and A2 each indicates amplitude of a pressure calculated by the CPU 101 from the pressure waveform; A1 indicates amplitude (first value) of a pressure when a stirring operation is being performed, and A2 indicates amplitude (second value) of a pressure when no stirring operation is being performed. As is clear from FIG. 7, pressure fluctuations occurring when the stirring operation is being performed are larger than those when no stirring operation is being performed. A reason why the pressure fluctuations are large when the stirring operation is being performed is that reciprocation of the stirring member 30 causes ink to flow in the ink bag 22 and the ink supply path being a sealed space including the second liquid chamber 13 of the recording head section 1. The amount of fluctuations in pressure varies with the material of the ink bag 22 or the ink supply tube 3, the shape of the stirring member 30, the operating speed of the stirring member 30, the viscosity of ink, the amount of ink remaining in the ink bag 22, or other factors. In FIG. 7, the pressure also fluctuates even when no stirring operation is being performed because of the occurrence of electric noise.

The stirring member 30 is determined to normally operate when the following expression (1) is satisfied:

$$A1 > T \times A2 \quad (1)$$

where A1 is the amplitude (first value) of a pressure occurring when a stirring operation is being performed and A2 is the amplitude (second value) of a pressure occurring when no stirring operation is being performed.

In other words, the stirring member 30 is determined to be anomalous when the value of A1/A2, which is obtained by dividing the first value A1 by the second value A2, is at or below a threshold. Here, T is the threshold and may be stored in advance in the ROM 102 of the liquid ejection apparatus. The values of A1 and A2 vary depending on an individual difference of the liquid ejection apparatus, an operating environment of the liquid ejection apparatus, and the type of used ink. Therefore, the value of T may be set using data obtained from actual operation of the liquid ejection apparatus. In this case, T is stored in the RAM 103. With a configuration in which a plurality of ink tanks is attached to a liquid ejection apparatus, the value of T may be set for each ink tank.

It may be determined whether the stirring member 30 is anomalous based on a result obtained by filtering an output of the pressure sensor 26 through a low-pass filter. In this case, the determination can be facilitated because filtering the output of the sensor through the low-pass filter can remove a high-frequency component of the sensor output signal. The low-pass filter may be embedded as an electric circuit in the liquid ejection apparatus or may be embedded in a control program for causing the liquid ejection apparatus to operate.

Referring back to the flowchart of FIG. 6, the operation sequence of the liquid ejection apparatus is further described. When it is determined in S105 that the pressure waveform is normal (YES in S105), the stirring member 30 is determined to normally operate in S106. When it is determined in S105 that the pressure waveform is anomalous (NO in S105), the ink supply system of the liquid ejection apparatus is determined to be anomalous in S107. Possible causes for anomaly in the ink supply system are described below. A first possible cause is that the stirring member does not operate. A second possible cause is that, although the stirring member operates, the ink supply path upstream of the pressure sensor is clogged and fluctuations in pressure caused by the operation of the stirring member do not reach the pressure sensor. A third possible cause is that, although the stirring member operates, a leakage occurs in the ink supply path and the pressure sensor cannot detect fluctuations in pressure caused by the operation of the stirring member.

When the stirring member 30 is determined to normally operate in S106, an operation of driving the suction pump 17 and detecting the pressure in the ink supply path by the pressure sensor 26 is carried out in S108.

The operation of driving the suction pump 17 and detecting the pressure in the ink supply path by the pressure sensor 26 in S108 is carried out in the following way. First, detection by the pressure sensor 26 is started, and results of the detection are sequentially stored in the RAM 103. Then the suction pump 17 is driven for a specific period of time while the cap 16 is in contact with the nozzle portion 11. When a specific period of time has elapsed after the completion of the driving of the suction pump 17, the detection by the pressure sensor 26 is completed.

When the ink supply path downstream of the pressure sensor 26 is normal, driving the suction pump 17 causes the supply control valve 14 to be opened, and a negative pressure formed by the suction pump 17 is conveyed along the ink supply tube 3. This generates a difference between the pressure upstream of and the pressure downstream of the differential pressure valve 27 and closes the differential pressure valve 27. When in this state the suction pump 17 is further driven, a negative pressure is applied to the sealed space downstream of the differential pressure valve 27 and an increase in negative pressure is detected by the pressure sensor 26. When the ink supply path downstream of the pressure sensor 26 is clogged, even if the suction pump 17 is driven, a negative pressure formed by the suction pump 17 is not conveyed to the differential pressure valve 27. Thus the differential pressure valve 27 is not closed, and no increase in negative pressure is detected by the pressure sensor 26.

Next, in S109, it is determined whether the pressure waveform obtained by the pressure sensor 26 is normal. When in S109 an increase in negative pressure is detected by the pressure sensor 26 (YES in S109), it is determined in S110 that the ink supply path downstream of the pressure sensor 26 is normal and the differential pressure valve 27 is normal. When in S109 no increase in negative pressure is detected by the pressure sensor 26 (NO in S109), it is determined in S111 that the ink supply path downstream of the pressure sensor 26 is clogged.

As described above, an operation of driving the suction pump 17 and detecting the pressure in the ink supply path by the pressure sensor 26 enables detection of whether the ink supply path downstream of the pressure sensor 26 is anomalous.

Second Embodiment

For the first embodiment, both the operation of driving the stirring member 30 and detecting the pressure in the ink supply path by the pressure sensor 26 and the operation of driving the suction pump 17 and detecting the pressure in the ink supply path by the pressure sensor 26 are carried out. In contrast, for the present embodiment, only the operation of driving the stirring member 30 and detecting the pressure in the ink supply path by the pressure sensor 26 is carried out.

Figure 8:
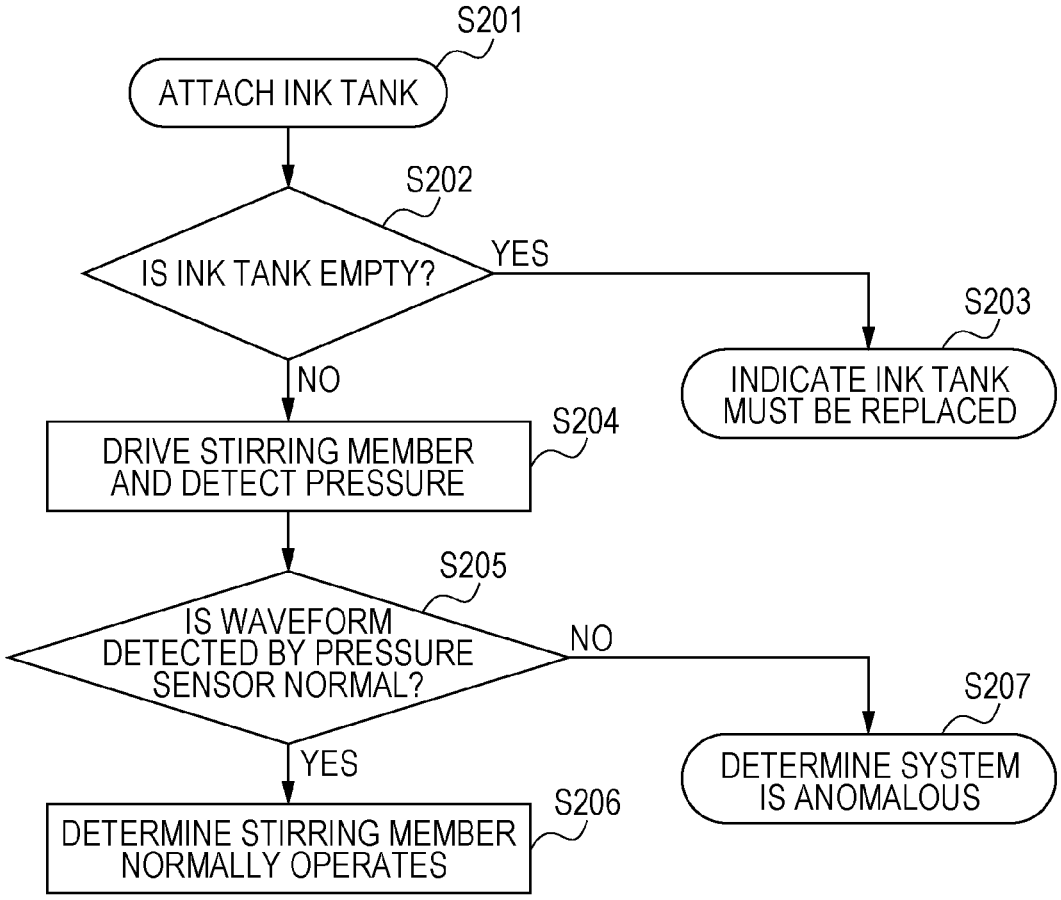
FIG. 8 is a flowchart of an operation sequence according to a second embodiment.

FIG. 8 is a flowchart of an operation sequence according to the second embodiment.

In S204, the stirring member 30 is driven and the pressure in the ink supply path is detected by the pressure sensor 26. When it is determined in S205 that the pressure waveform is normal (YES in S205), the stirring member 30 is determined to normally operate in S206. When it is determined in S205 that the pressure waveform is anomalous (NO in S205), the ink supply system of the liquid ejection apparatus is determined to be anomalous in S207. Possible causes for anomaly in the ink supply system are described below. A first possible cause is that the stirring member does not operate. A second possible cause is that, although the stirring member operates, the ink supply path upstream of the pressure sensor is clogged. A third possible cause is that, although the stirring member operates, a leakage occurs in the ink supply path.

When in S206 the stirring member 30 is determined to normally operate, the operation sequence is completed.

This can shorten the time required for detection. In this case, although clogging of the ink supply path downstream of the pressure sensor 26 cannot be detected, ink does not leak in the liquid ejection apparatus, so critical malfunctions do not occur in the apparatus.

Third Embodiment

For the present embodiment, only the operation of driving the suction pump 17 and detecting the pressure in the ink supply path by the pressure sensor 26 is carried out.

Figure 9:
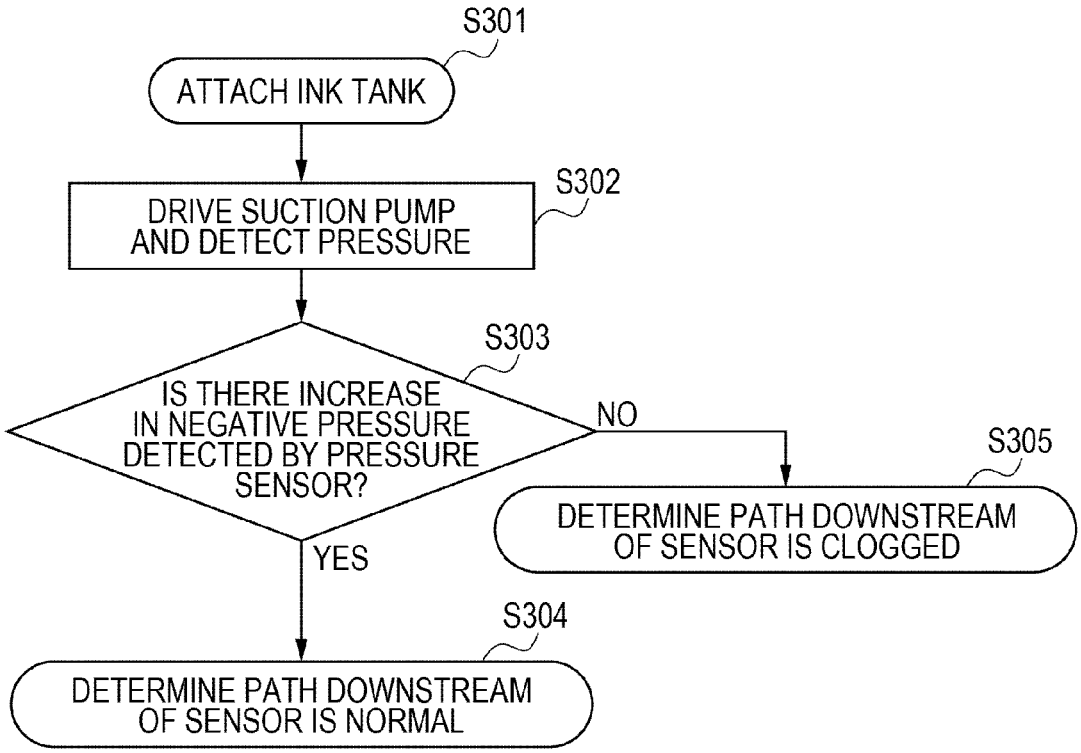
FIG. 9 is a flowchart of an operation sequence according to a third embodiment.

FIG. 9 is a flowchart of an operation sequence according to the third embodiment.

In S302, the suction pump 17 is driven and the pressure in the ink supply path is detected by the pressure sensor 26. Then in S303, it is determined whether the pressure waveform obtained by the pressure sensor 26 is normal. When in S303 an increase in negative pressure is detected by the pressure sensor 26 (YES in S303), it is determined in S304 that the ink supply path downstream of the pressure sensor 26 is normal and the differential pressure valve 27 is normal. When in S303 no increase in negative pressure is detected by the pressure sensor 26 (NO in S303), the ink supply path downstream of the pressure sensor 26 is determined to be anomalous in S305.

As described above, for the present embodiment, the operation of driving the suction pump 17 and detecting the pressure in the ink supply path by the pressure sensor 26 enables detection of whether the ink supply path downstream of the pressure sensor 26 is anomalous.

Modifications

For the first and second embodiments, if it is determined that the pressure waveform occurring when the stirring member 30 performs a stirring operation is anomalous and the ink supply path is anomalous, it is useful that secondary troubles, such as leakage of ink, be avoided. Specifically, an indication that instructs a user to detach the ink tank 20 from the main body of the apparatus is provided and, when detachment of the ink tank 20 from the main body of the apparatus is detected, the suction pump 17 is driven and the ink in the ink supply path is removed. This can prevent degradation in a recorded image or occurrence of breakage of the liquid ejection apparatus that would be caused by a recording operation performed in a condition where a malfunction exists.

For the first to third embodiments, immediately after the ink tank 20 is attached, the operation of detecting the pressure in the ink supply path by the pressure sensor 26 is carried out. However, that operation may also be carried out at other timing. For example, if the liquid ejection apparatus has a paper jam, a user may touch the ink supply tube 3 and damage the ink supply tube 3 while trying to clear the paper jam. To avoid this, the operation of detecting the pressure in the ink supply path by the pressure sensor 26 may be carried out after a paper jam is cleared.

The stirring operation and the operation of detecting a pressure may be carried out in a sequence of activation of the liquid ejection apparatus immediately after the power of the liquid ejection apparatus is turned on. With this, even if a malfunction occurs in the stirring member 30 or the ink supply tube 3 while the liquid ejection apparatus is not used, the malfunction can be promptly detected.

For the first and second embodiments, a malfunction occurring in the ink supply path is detected employing the stirring operation by the stirring member 30. However, a configuration that does not employ the stirring member 30 may be used as long as it can apply a fluctuating pressure to ink in the ink tank. For example, a configuration in which a pressure pump for generating a pressure for supplying ink is intermittently driven may be used. Alternatively, a configuration in which a pump capable of increasing and reducing a pressure is driven so as to alternately add a positive pressure and a negative pressure to ink in the ink tank 20 may be used.

For the above-described embodiments, the recording head section 1 is mounted on the carriage and moved. Thus it is useful that the operation of detecting the pressure in the ink supply path by the pressure sensor 26 be carries out when the carriage is at rest. The present invention is not limited to the configuration in which the recording head section 1 is mounted on the carriage and moved. The present invention is also applicable to a so-called full-multi-type recording apparatus in which a recording head section is fixed to the main body of the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-273894 filed Dec. 1, 2009, which is hereby incorporated by reference herein in its entirety.

What is claimed is:

1. A liquid ejection apparatus comprising:

a recording head configured to eject ink;

an ink tank configured to hold ink to be supplied to the recording head;

a stirring member configured to stir ink in the ink tank;

an ink supply path configured to supply ink from the ink tank to the recording head;

a pressure sensor configured to detect a pressure in the ink supply path; and a determining unit configured to determine whether the stirring member is normal based on a first value detected by the pressure sensor when the stirring member is caused to drive and a second value detected by the pressure sensor when the stirring member is not caused to drive.

2. The liquid ejection apparatus according to claim 1, wherein the ink in the ink tank is pigment ink.

3. The liquid ejection apparatus according to claim 1, wherein the determining unit is configured to determine that the ink supply path is anomalous when a value obtained by dividing the first value by the second value is at or below a threshold.

4. The liquid ejection apparatus according to claim 1, further comprising:

an attachment detection sensor configured to detect attachment of the ink tank to the liquid ejection apparatus, wherein the determining unit is configured to determine whether the ink supply path is anomalous in response to detection of the attachment of the ink tank by the attachment detection sensor.

5. The liquid ejection apparatus according to claim 1, further comprising:

a differential pressure valve arranged in the ink supply path upstream of the pressure sensor; and a suction unit configured to suck ink from the recording head, wherein the determining unit is configured to determine whether the ink supply path is anomalous based on a result of detection of the pressure in the ink supply path by the pressure sensor performed in response to driving of the suction unit using a negative pressure greater than a pressure required for closing the differential pressure valve.

6. The liquid ejection apparatus according to claim 5, wherein the suction unit includes a cap and a suction pump, wherein the cap is capable of coming into contact with a nozzle portion of the recording head, and the suction pump is configured to make an inside of the cap be in a negative pressure state to discharge ink through the nozzle portion.

7. The liquid ejection apparatus according to claim 5, wherein the determining unit is configured to determine that the ink supply path is anomalous when the pressure sensor does not detect an increase in negative pressure in the ink supply path in the detection performed in response to driving of the suction unit.

* * * * *